US006745863B2

(12) United States Patent
Tsukui et al.

(10) Patent No.: US 6,745,863 B2
(45) Date of Patent: Jun. 8, 2004

(54) EXHAUST SYSTEM STRUCTURE FOR MOTORCYCLE

(75) Inventors: Hiroaki Tsukui, Saitama (JP); Takao Mikami, Saitama (JP); Eiichi Kanda, Saitama (JP); Shin Watanabe, Saitama (JP); Shin Sato, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/107,055

(22) Filed: Mar. 28, 2002

(65) Prior Publication Data

US 2002/0153187 A1 Oct. 24, 2002

(30) Foreign Application Priority Data

Apr. 4, 2001 (JP) ..... 2001-105719

(51) Int. Cl.[7] ..... B60K 13/04; B62D 61/02
(52) U.S. Cl. ..... 180/309; 180/219; 181/265
(58) Field of Search ..... 180/219, 309; 181/265

(56) References Cited

U.S. PATENT DOCUMENTS 4,290,501 A * 9/1981 Tanaka ..... 181/228
4,327,811 A * 5/1982 Isaka ..... 180/219
4,422,519 A 12/1983 Nomura et al.
4,809,800 A * 3/1989 Suzuki ..... 180/219

FOREIGN PATENT DOCUMENTS

| | | | |
|---|---|---|---|
| DE | G 93 14 441.5 | 1/1994 | |
| JP | 58-6912 U | 1/1983 | |
| JP | 2-10071 | 3/1990 | |
| JP | 03134216 A * | 6/1991 | ..... F01N/7/08 |
| JP | 10 089043 | 4/1998 | |

* cited by examiner

*Primary Examiner*—Kevin Hurley
(74) *Attorney, Agent, or Firm*—Birch, Stewart, Kolasch & Birch, LLP

(57) ABSTRACT

The present invention relates to an improvement in an exhaust system structure for a motorcycle. A motorcycle has an engine disposed between front and rear wheels, an exhaust pipe extending from the engine, and a silencer connected to the exhaust pipe for discharging exhaust gases. The silencer, which is a heavy object, is of the type having a gas outlet disposed near a gas inlet. The silencer is disposed below the engine with the gas inlet facing toward the rear wheel, and the exhaust pipe extends to a position near the rear wheel and is connected to the gas inlet of the silencer. By elongating the length of the exhaust pipe and placing the silencer under the engine, the exhaust system performs sufficiently with high output engines, while at the same time lowers the center of gravity of a motorcycle body and balances the weight of the motorcycle body in its longitudinal direction.

18 Claims, 5 Drawing Sheets

EXHAUST SYSTEM STRUCTURE FOR MOTORCYCLE

CROSS-REFERENCE TO RELATED APPLICATIONS

The present application claims priority under 35 U.S.C. §119 to Japanese Patent Application No. 2001-105719, filed on Apr. 4, 2001, the entire contents thereof are hereby incorporated by reference.

BACKGROUND OF THE INVENTION

1. Field of the Invention

The present invention relates to an improvement in an exhaust system structure for a motorcycle.

2. Description of Background Art

Exhaust system structures for motorcycles are arranged such that exhaust gases emitted from an engine disposed between front and rear wheels are discharged through an exhaust pipe and a silencer into the atmosphere. One such exhaust system structure for motorcycles is known from Japanese utility model publication No. 2-10071 entitled "Motorcycle with cowling" (hereinafter referred to as "prior art 1").

As shown in FIG. 2 of the publication of the prior art 1, the prior art 1 relates to an exhaust system structure in which an exhaust pipe 32 extends rearward from an engine 23 disposed between a front wheel 11 and a rear wheel 14, and a muffler 34 is connected to the rear end of the exhaust pipe 32 (the reference numerals are those cited in the publication). Therefore, the muffler 34 is disposed laterally of an upper portion of the rear wheel 14.

With the prior art 1, since the muffler 34 which is a heavy object is disposed in an upper portion of the motorcycle body, the center of gravity of the motorcycle body tends to be elevated. Because the muffler 34 which is a heavy object is disposed in a rear portion of the motorcycle body, the weight of the motorcycle body needs to be balanced in its longitudinal direction in order to increase the maneuvering capability of the motorcycle.

To solve the above problems, an arrangement disclosed in Japanese laid-open patent publication No. 58-6912 entitled "Silencer device for motorcycle" (hereinafter referred to as "prior art 2") may be employed.

As shown in FIG. 1 of the publication of the prior art 2, the prior art 2 relates to an exhaust system structure in which an engine 11 is disposed between a front wheel (no reference numeral) and a rear wheel 13, a muffler body 14 is disposed beneath the engine 11, an exhaust pipe 12 extends downwardly from a front portion of the engine 11, a gas inlet in the front portion of the muffler body 14 is connected to the exhaust pipe 12, and exhaust gases are discharged from a gas outlet in the rear portion of the muffler body 14.

According to the prior art 2, since the muffler body 14 which is a heavy object is disposed in a low position near the engine 11, the center of gravity of the motorcycle body is lowered. The layout is advantageous in balancing the weight of the motorcycle body in its longitudinal direction.

Motorcycles include medium and large-size motorcycles which can be driven at high speeds. For motorcycles to be able to be driven at high speeds, high-output engines may be installed thereon. For performing the capabilities of such a high-output engine, it is necessary for the exhaust pipe 12 to have at least a certain length. However, because the muffler body 14 is disposed near the engine 11 according to the prior art 2, it is difficult to increase the length of the exhaust pipe 12 simply by elongating the exhaust pipe 12.

SUMMARY AND OBJECTS OF THE INVENTION

It is therefore an object of the present invention to provide a technique for (1) maintaining the length of an exhaust pipe in order to sufficiently perform the capabilities of an engine, and (2) placing a silencer which is a heavy object in a position advantageous to lower the center of gravity of a motorcycle body and balance the weight of the motorcycle body in its longitudinal direction.

To achieve the above object, there is provided in accordance with claim 1 an exhaust system structure in a motorcycle having an engine disposed between front and rear wheels, an exhaust pipe extending from the engine, and a silencer connected to the exhaust pipe for discharging exhaust gases, characterized in that said silencer is of the type having a gas outlet disposed near a gas inlet, the silencer is disposed below the engine with the gas inlet facing toward the rear wheel, and the exhaust pipe extends to a position near the rear wheel and is connected to the gas inlet of said silencer.

Since the silencer whose gas inlet faces toward the rear wheel is disposed below the engine and the exhaust pipe extends to a position near the rear wheel and is connected to the gas inlet of the silencer, the exhaust pipe extending from the engine to the gas inlet is elongated. Since a long exhaust pipe is used, the engine capability is sufficiently performed even if the engine is a high-output engine.

Because the silencer which is a heavy object is disposed below the engine that is disposed between the front and rear wheels, the center of gravity of the motorcycle body is lowered to reduce the inertia of rolling. Further, this layout is advantageous in keeping the weight of the motorcycle body in balance in its longitudinal direction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
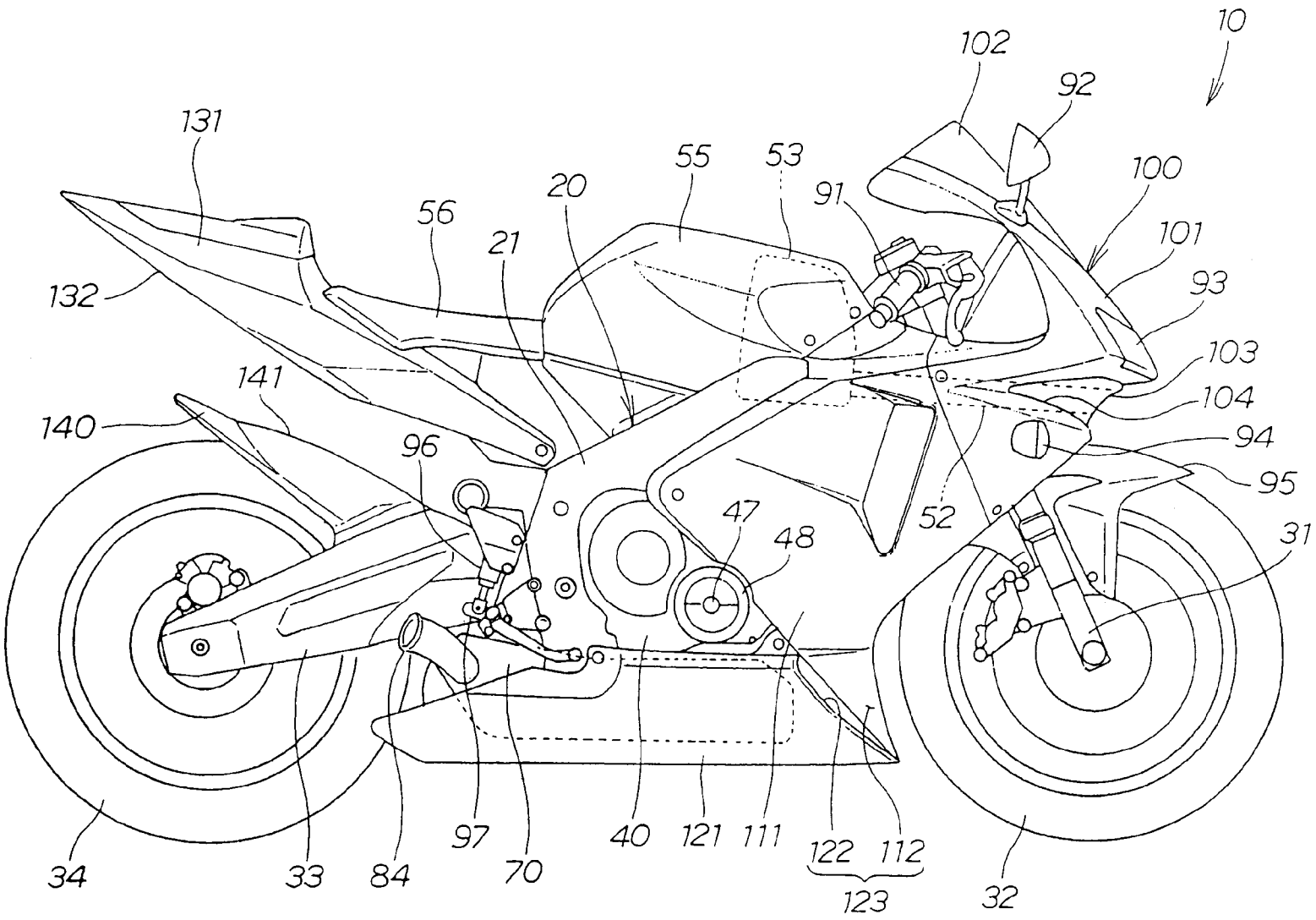
FIG. 1 is a right side elevational view of a motorcycle according to the present invention.

An embodiment of the present invention will be described below with reference to the accompanying drawings. The terms "front", "rear", "left", "right", "upper", and "lower" used in the description refer to directions as viewed from the driver of the motorcycle. The figures should be viewed in the direction in which the reference characters look in the correct directional orientation.

FIG. 1 is a right side elevational view of a motorcycle according to the present invention, showing the appearance of a motorcycle 10. The motorcycle 10 has a front wheel 32 mounted on a front portion of a motorcycle frame 20 by a front fork 31, a rear wheel 34 mounted on a rear portion of the motorcycle frame 20 by a swing arm 33, an engine 40 mounted on a longitudinally central lower portion of the motorcycle frame 20, and an air cleaner 53, a fuel tank 55, and a seat 56 which are mounted on a longitudinally central upper portion of the motorcycle frame 20.

According to the present invention, the engine 40 is disposed between the front and rear wheels 32, 34 and a silencer 70 is disposed below the engine 40. The silencer 70 is mounted on the motorcycle frame 20 or the engine 40.

The motorcycle 10 has a cowling 100 comprising a front cowl 101 covering an upper front portion of the motorcycle body, left and right middle cowls 111 (only the right middle cowl is shown in FIG. 1) covering a front middle portion of the motorcycle body, left and right lower cowls 121 covering a lower portion of the motorcycle body and sides of the silencer 70, and a rear cowl 131 covering a rear portion of the motorcycle body.

The front cowl 101, the left and right middle cowls 111, and the left and right lower cowls 121 are separably coupled to each other by screws. Specifically, upper front portions of the left and right middle cowls 111 (forward cowls) are separable from a lower portion of the front cowl 101, and front end portions of the lower cowls (rearward cowls) 121 are separable from lower rear end portions of the middle cowls 111 in a position forward of the silencer 70.

The front cowl 101 has a window screen 102 on its upper portion and a pair of left and right air inlet ports 103 in its front portion.

The middle cowls (forward cowls) 111 each have a recess 112 defined in a lower rear end thereof and extending toward the center of the motorcycle body, and the lower cowls (rearward cowls) 121 each have a front opening 122 defined in a front end thereof. The front opening 122 and the recess 112 are combined into a large air inlet port 123 for cooling the silencer 70.

FIG. 1 also shows a rear fender 140 disposed below the rear cowl 131 and mounted on the swing arm 33. According to the present invention, the rear cowl 131 has a lower edge 132 inclined substantially linearly in a rearward upward direction, and the rear fender 140 has an upper surface 141 inclined substantially linearly in a rearward upward direction parallel to the lower edge 132 of the rear cowl 131.

In FIG. 1, 47 represents the crankshaft of the engine, 48 a cover member (crankshaft cover), 91 a handle, 92 a mirror, 93 a head lamp, 94 a winker, 95 a front fender, 96 a rear cushion unit, and 97 a cushion link. The silencer 70 has a rear portion extending to a position near the cushion link 97.

Figure 2:
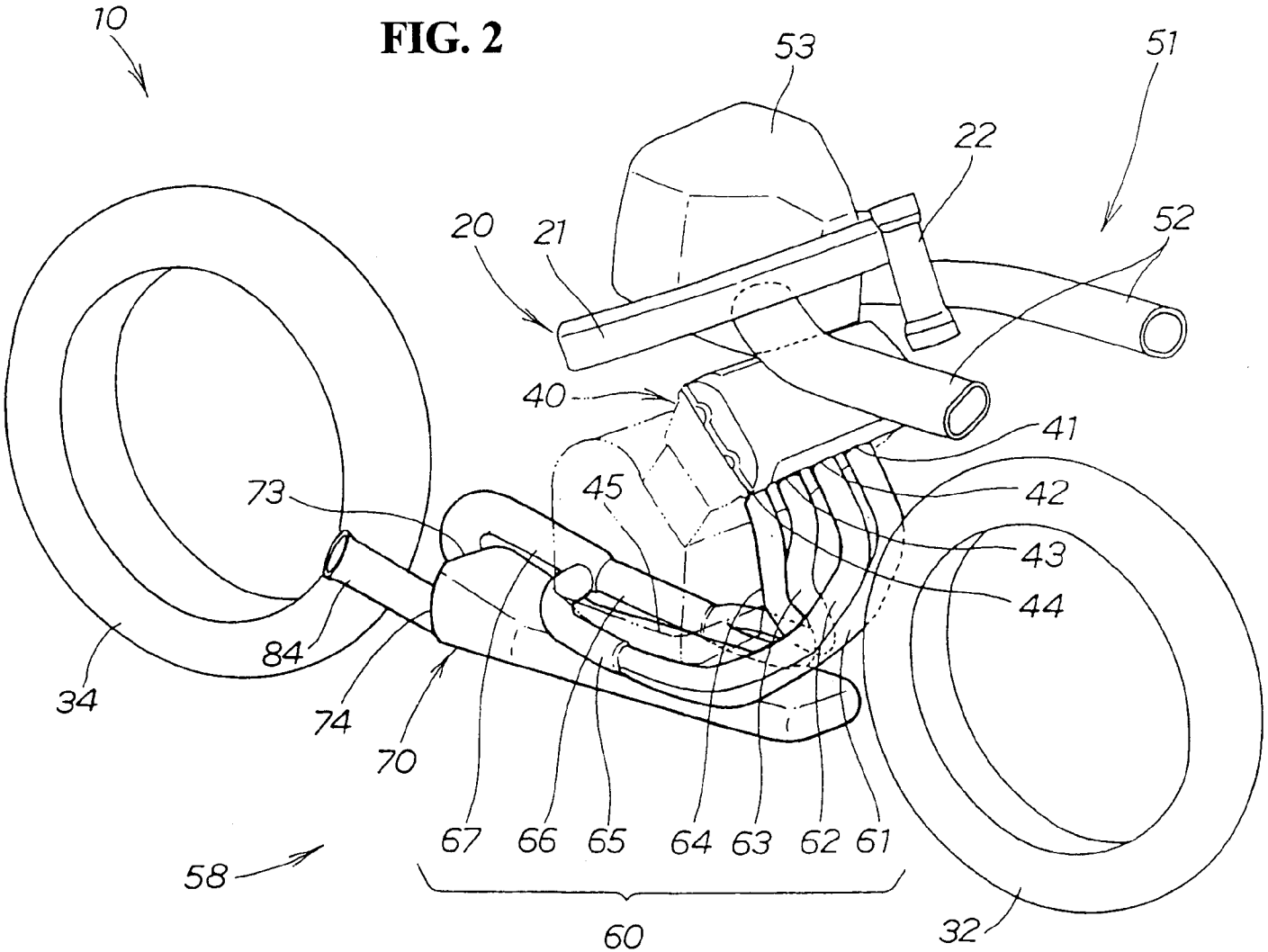
FIG. 2 is a perspective view of a major part of an intake/exhaust system structure of the motorcycle according to the present invention.

FIG. 2 is a major perspective view of an intake/exhaust system structure of the motorcycle according to the present invention. The motorcycle 10 has an intake system 51 comprising a pair of left and right air intake ports 103 defined in the front cowl 101 shown in FIG. 1, a pair of left and right air ducts (intake ducts) 52 extending rearwardly from the intake ports 103, and an air cleaner 53 connected to tip ends of the air ducts 52. The air cleaner 53 is disposed between a pair of left and right main pipes 21 of the motorcycle frame 20. 22 represents a head pipe.

The engine 40 comprises a four-cylinder engine having a transverse row of four exhaust ports 41 through 44 in its upper front portion and an oil pan 45 in its lower rear portion. The motorcycle 10 has an exhaust system 58 which is a device for discharging exhaust gases through an exhaust pipe 60 extending from the exhaust ports 41 through 44 of the engine 40 and the silencer 70 which is connected to the exhaust pipe 60.

The silencer 70 is of the type having a gas outlet 74 in the vicinity of a gas inlet 73. The silencer 70 is disposed below the engine 40 with the gas inlet 73 facing toward the rear wheel 34, and the exhaust pipe 60 extends to a position near the rear wheel 34 and is connected to the gas inlet 73 of the silencer 70.

The four exhaust ports are referred to as a first exhaust port 41, a second exhaust port 42, a third exhaust port 43, and a fourth exhaust port 44 successively from the left (right in FIG. 2) to the right of the motorcycle body.

The exhaust pipe 60 comprises four pipes (a first pipe 61, a second pipe 62, a third pipe 63, and a fourth pipe 64) and three joint pipes (a first joint pipe 65, a second joint pipe 66, and a third joint pipe 67).

The first pipe 61 has an end connected to the first exhaust port 41, extends downwardly to the right, and extends rearwardly along a right side of the oil pan 45. Similarly, the second pipe 62 has an end connected to the second exhaust port 42, extends downwardly to the right, and extends rearwardly along the right side of the oil pan 45. The other end of the first pipe 61 and the other end of the second pipe 62 are connected together to an end of the first joint pipe 65. The first joint pipe 65 extends rearwardly along the right side of the oil pan 45 and then extends to the left.

The third pipe 63 has an end connected to the third exhaust port 43, extends downwardly to the left, and extends rearwardly along a left side of the oil pan 45. Similarly, the fourth pipe 64 has an end connected to the fourth exhaust port 44, extends downwardly to the left, and extends rearwardly along the left side of the oil pan 45. The other end of the third pipe 63 and the other end of the fourth pipe 64 are connected together to an end of the second joint pipe 66. The second joint pipe 66 extends rearwardly along the left side of the oil pan 45.

The other end of the first joint pipe 65 and the other end of the second joint pipe 66 are connected together to the third joint pipe 67. In this manner, the four pipes 61 through 64 are connected together to the single third joint pipe 67. The third joint pipe 67 extends rearwardly and is connected to the gas inlet 73.

Figure 3:
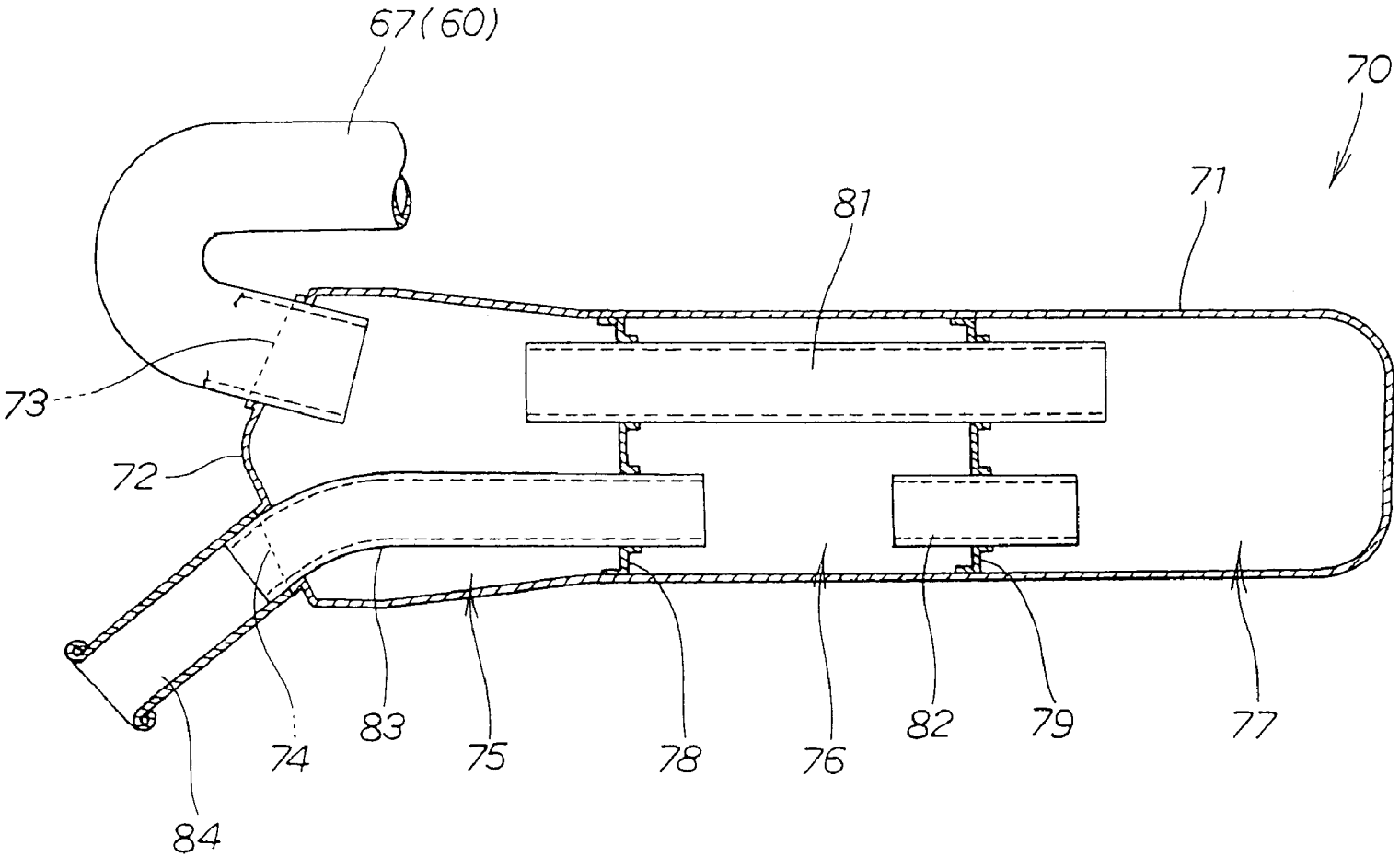
FIG. 3 is a sectional plan view of a silencer according to the present invention.

FIG. 3 is a sectional plan view of the silencer according to the present invention. The silencer 70 comprises a closed tubular body 71 which is slender and elongate in its longitudinal direction, the gas inlet 73 and the gas outlet 74 which are defined in a rear end 72 of the tubular body 71, and first and second division plates 78, 79 dividing the interior of the tubular body 71 into three expansion chambers 75 through 77 in its longitudinal direction.

The first expansion chamber 75, the second expansion chamber 76, and the third expansion chamber 77 are disposed in the tubular body 71 successively in the order named forward (rightward in FIG. 3) from the rear end 72. The first expansion chamber 75 communicates with the gas inlet 73, and the third expansion chamber 77 communicates with the first expansion chamber 75 through a first communication pipe 81. The second expansion chamber 76 communicates with the third expansion chamber 77 through a second communication pipe 82, and the gas outlet 74 communicates with the second expansion chamber 76 through a third communication pipe 83. A tail pipe 84 is connected to the gas outlet 74.

Exhaust sounds can be attenuated by the expansion of exhaust gases as they enter the first, second, and third expansion chambers 75 through 77.

Operation of the exhaust system 58 thus constructed will be described below with reference to FIG. 2.

Since the silencer 70 is disposed below the engine 40 with the gas inlet 73 facing toward the rear wheel 34, and the exhaust pipe 60 extends to the position near the rear wheel 34 and is connected to the gas inlet 73 of the silencer 70, the exhaust pipe 60 extending from the engine 40 to the gas inlet 73 is elongated. Since the exhaust pipe 60 is long, the engine capability is sufficiently performed even if the engine 40 is a high-output engine.

Because the silencer 70 which is a heavy object is disposed below the engine 40 that is disposed between the front and rear wheels 32, 34, the center of gravity of the motorcycle body is lowered to reduce the inertia of rolling. This layout is also advantageous for keeping the weight of the motorcycle body in balance in its longitudinal direction.

Figure 4:
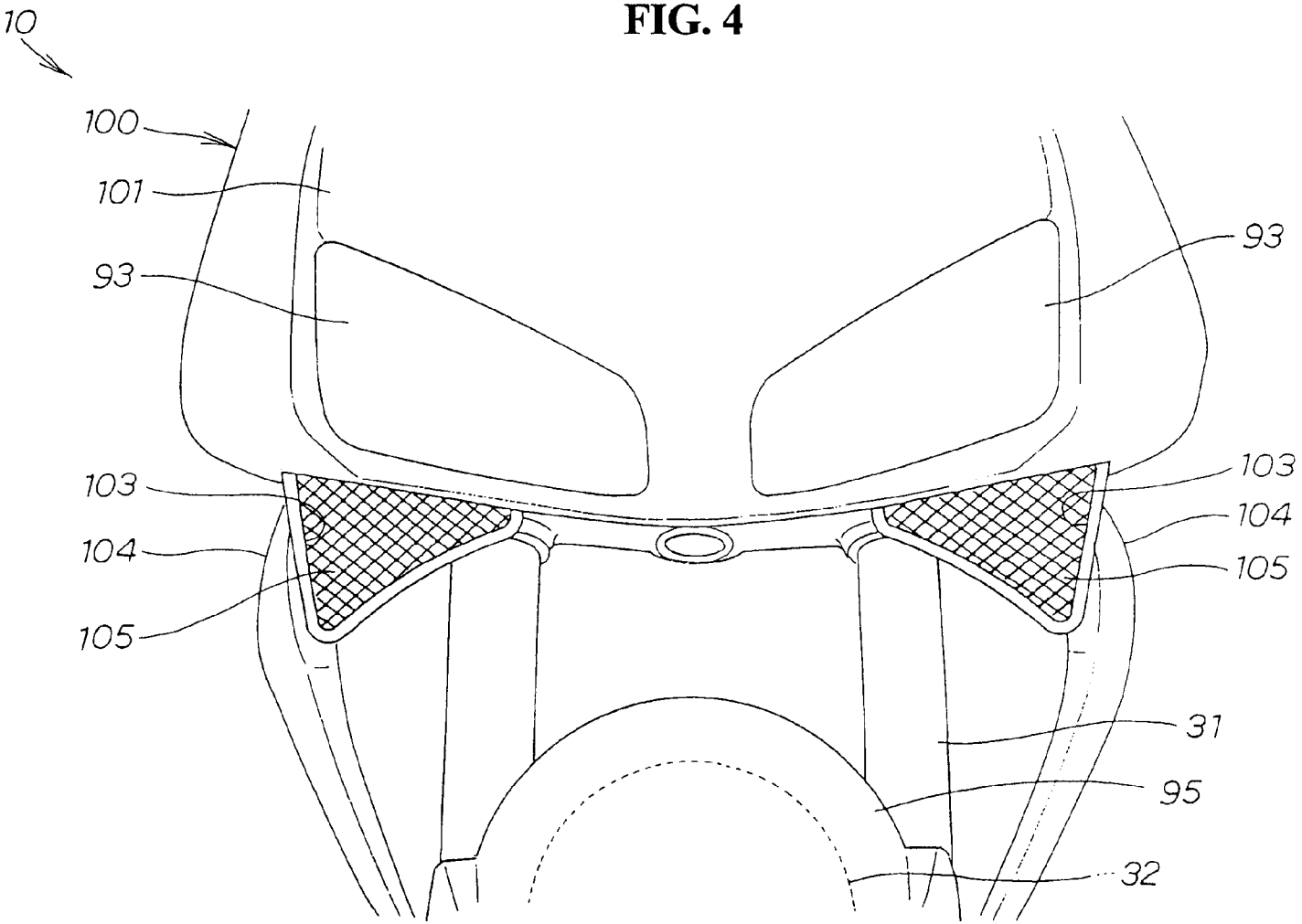
FIG. 4 is a front elevational view of a portion around air inlet ports of the motorcycle according to the present invention.

FIG. 4 is a front elevational view of a portion around the air inlet ports of the motorcycle according to the present invention. The left and right air inlet ports 103 are disposed in respective left and right positions outside of the front fork 31, and the front cowl 101 has left and right recesses 104 defined outside of and adjacent to the left and right air inlet ports 103. The air inlet ports 103 have respective screens 105 for preventing foreign matter from entering the air inlet ports 103.

Because the air inlet ports 103 are disposed in the respective left and right positions outside of the front fork 31, efforts to increase the opening area of the air inlet ports 103 do not tend to be limited by the layout of other members around the air inlet ports 103. Therefore, the opening area of the air inlet ports 103 can be increased to supply a sufficient amount of air (ramming air) to the engine 40 (see FIG. 2). As a result, the capability of the engine 40 can sufficiently be performed.

Since the air inlet ports 103 are disposed respectively on left and right sides of the front wheel 32 which is located centrally in the transverse direction of the motorcycle body, the air inlet ports 103 do not interfere with the front wheel 32 even when the front wheel 32 is lifted the most. Therefore, there is no need to increase the height of the air inlet ports 103, which do not impose limitations on the design of the motorcycle 10.

Figure 5:
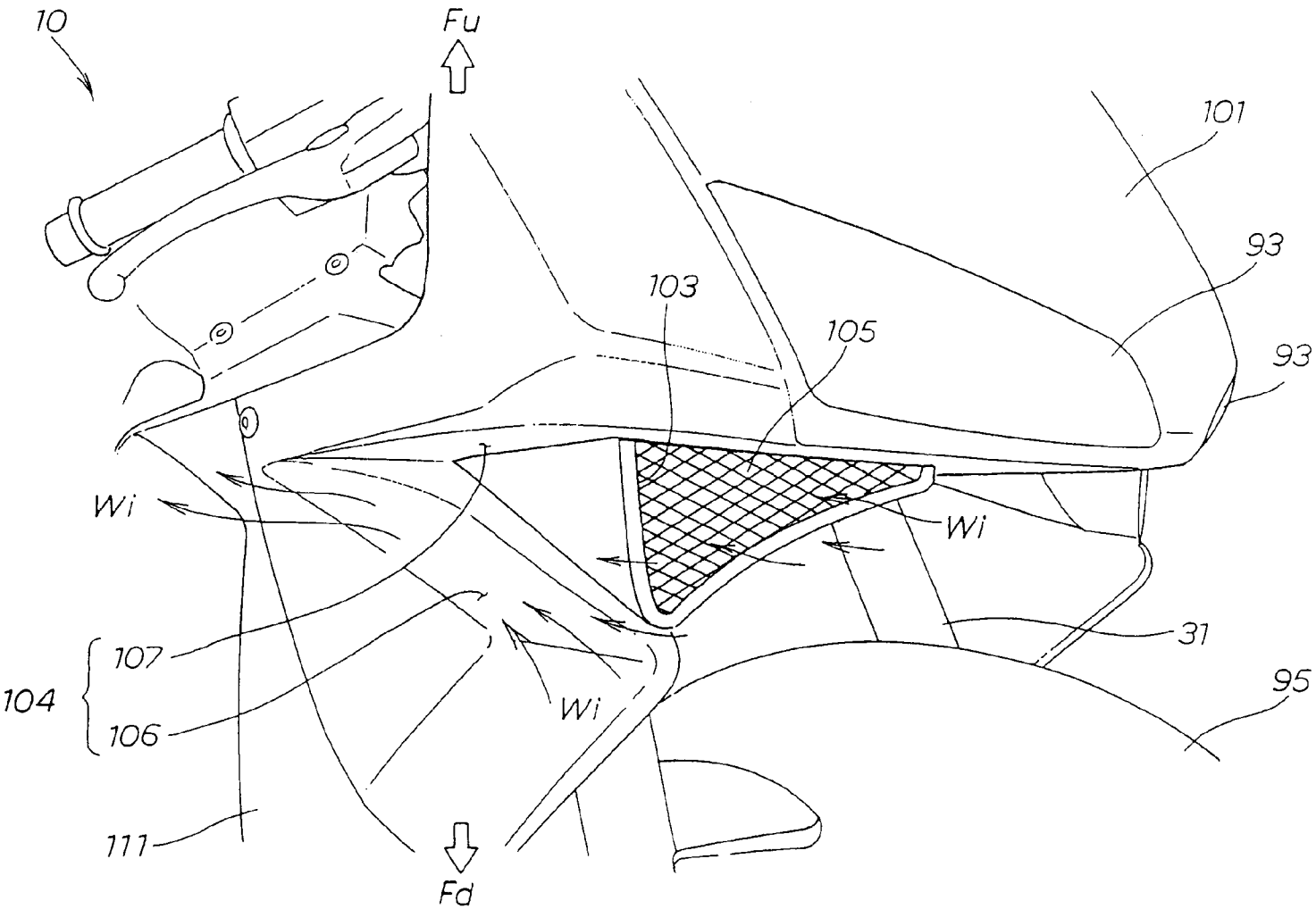
FIG. 5 is a perspective view of a portion around the air inlet ports of the motorcycle according to the present invention.

FIG. 5 is a perspective view of a portion around the air inlet ports of the motorcycle according to the present invention. FIG. 5 shows that the recesses 104 defined in the front cowl 101 are "left dogleg-shaped" in side elevation, and air Wi which does not enter the air inlet ports 103 flows along the recesses 104.

Each of the recesses 104 has a lower slanted surface 106 and an upper slanted surface 107. The lower and upper slanted surfaces 106, 107 have side corners defined by relatively large curved surfaces.

Since the recesses 104 which are "left dogleg-shaped" in side elevation are defined in the front cowl 101 and disposed outside of and adjacent to the air inlet ports 103, and air (ramming air) Wi which does not enter the air inlet ports 103 flows along the recesses 104, the flow of air Wi which does not enter the air inlet ports 103 is rectified and flows rearwardly. The flow of air Wi thus rectified is advantageous in increasing the running capability of the motorcycle 10.

The lower slanted surface 107 is inclined upwardly in the rearward direction from the front of the motorcycle. When the air Wi flows along the lower slanted surface 106 thus inclined, the lower slanted surface 106 serves as an air spoiler for generating a downward force to press the motorcycle 10 downwardly.

The air (ramming air) Wi flows upwardly in the rearward direction along the lower slanted surface 106 and passes rearwardly across the side corner. When the air Wi thus passes along the lower slanted surface 106, it produces a downward force Fd to press the motorcycle 10 downwardly. As a result, a lifting force Fu which is generated when the motorcycle 10 is running is reduced by the downward force Fd. Accordingly, the gripping force of the tire of the front wheel 32 (see FIG. 1) is maintained to achieve a comfortable high-speed running capability.

In summary, the silencer of the present invention is of the type having a gas outlet disposed near a gas inlet, and is disposed below the engine with a gas inlet facing toward the rear wheel, and the exhaust pipe extends to a position near the rear wheel and is connected to the gas inlet of the silencer, and therefore the exhaust pipe extending from the engine to the gas inlet is elongated. Further, silencer which is a heavy object is disposed below the engine that is disposed between the front and rear wheels.

The above configuration offers the following advantages. First, since the exhaust pipe is sufficiently long, the engine capability is sufficiently performed even if the engine is a high-output engine. Second, since the silencer is disposed between the front and rear wheels, the center of gravity of the motorcycle body is lowered to reduce the inertia of rolling. Also, the layout is advantageous for maintaining the weight of the motorcycle body in balance in its longitudinal direction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust system structure in a motorcycle having an engine disposed between front and rear wheels, an exhaust pipe extending from the engine, and a silencer connected to the exhaust pipe for discharging exhaust gases, characterized in that said silencer has a gas outlet disposed near a gas inlet, the silencer is disposed below the engine with the gas inlet facing toward the rear wheel, and the exhaust pipe extends to a position beyond a rear face of the silencer near the rear wheel and is connected to the gas inlet on the rear face of said silencer.

2. The exhaust system structure in a motorcycle according to claim 1, wherein said exhaust pipe includes four pipes connecting at forward ends thereof to said engine and at the rear ends thereof to a first and a second of three joint pipes.

3. The exhaust system structure in a motorcycle according to claim 2, wherein said first and said second of said three joint pipes extend rearwardly along an oil pan and merge into a third of said three joint pipes.

4. The exhaust system structure in a motorcycle according to claim 2, wherein a third of said three joint pipes is U-shaped and connects in a forward facing direction to the gas inlet of the silencer.

5. The exhaust system structure in a motorcycle according to claim 1, wherein the silencer includes a closed tubular body which is slender and elongate in its longitudinal direction, and the gas inlet and the gas outlet which are defined in a rear end of the tubular body.

6. The exhaust system structure in a motorcycle according to claim 1, wherein the silencer is disposed below an oil pan of said engine, and has a rear portion extending to a position near a cushion link.

7. An exhaust system structure in a motorcycle with an engine, comprising:

an exhaust pipe extending from the engine to a position near the rear wheel;

a silencer disposed below the engine; and a gas inlet and a gas outlet of said silencer, each being disposed at a rear end of said silencer and facing said rear wheel, wherein said exhaust pipe extends to a position near the rear wheel and is connected to the gas inlet of said silencer for discharging exhaust gases.

8. The exhaust system structure in a motorcycle according to claim 7, wherein said exhaust pipe includes four pipes connecting at forward ends thereof to said engine and at the rear ends thereof to a first and a second of three joint pipes.

9. The exhaust system structure in a motorcycle according to claim 8, wherein said first and said second of said three joint pipes extend rearwardly along an oil pan and merge into a third of said three joint pipes.

10. The exhaust system structure in a motorcycle according to claim 8, wherein a third of said three joint pipes is U-shaped and connects in a forward facing direction to the gas inlet of the silencer.

11. The exhaust system structure in a motorcycle according to claim 7, wherein the silencer includes a closed tubular body which is slender and elongate in its longitudinal direction, and the gas inlet and the gas outlet which are defined in a rear end of the tubular body.

12. The exhaust system structure in a motorcycle according to claim 7, wherein the silencer is disposed below an oil pan of said engine, and has a rear portion extending to a position near a cushion link.

13. A motorcycle comprising:

an engine having at least two exhaust ports disposed between a front and a rear wheel;

an exhaust pipe extending from said at least two exhaust ports of the engine to a position near the rear wheel;

a silencer disposed below the engine; and a gas inlet and a gas outlet of said silencer, each being disposed near each other and facing said rear wheel, wherein said exhaust pipe extends to a position near the rear wheel and then curves forwardly to a position where it is connected to the gas inlet for discharging exhaust gases, the gas inlet being disposed on a rear face of the silencer.

14. The motorcycle according to claim 13, wherein said exhaust pipe includes four pipes connecting at forward ends thereof to said at least two exhaust ports and at the rear ends thereof to a first and a second of three joint pipes.

15. The motorcycle according to claim 14, wherein said first and said second of said three joint pipes extend rearwardly along an oil pan and merge into a third of said three joint pipes.

16. The motorcycle according to claim 14, wherein a third of said three joint pipes is U-shaped and connects in a forward facing direction to the gas inlet of the silencer.

17. The motorcycle according to claim 13, wherein the silencer includes a closed tubular body which is slender and elongate in its longitudinal direction, and the gas inlet and the gas outlet which are defined in a rear end of the tubular body.

18. The motorcycle according to claim 13, wherein the silencer is disposed below an oil pan of said engine, and has a rear portion extending to a position near a cushion link.

* * * * *